US006601489B2

(12) United States Patent
Reinders

(10) Patent No.: US 6,601,489 B2
(45) Date of Patent: Aug. 5, 2003

(54) CUTTING AND TRANSPORTING A SHEET WORKPIECE

(75) Inventor: Peter Reinders, Ochtrup (DE)

(73) Assignee: Schmale-Holding GmbH & Co., Ochtrup (DE)

( * ) Notice: Subject to any disclaimer, the term of this patent is extended or adjusted under 35 U.S.C. 154(b) by 35 days.

(21) Appl. No.: 09/755,603

(22) Filed: Jan. 5, 2001

(65) Prior Publication Data

US 2002/0026861 A1 Mar. 7, 2002

(30) Foreign Application Priority Data

Jan. 6, 2000 (DE) ..... 100 00 262
Apr. 19, 2000 (DE) ..... 100 19 383

(51) Int. Cl.[7] ..... B26D 7/06; B26D 5/20

(52) U.S. Cl. ..... 83/23; 83/153; 83/155; 83/206; 83/207; 83/262

(58) Field of Search ..... 83/236, 262, 277, 83/206, 282, 109, 151, 153, 155

(56) References Cited

U.S. PATENT DOCUMENTS 3,599,521 A * 8/1971 Lee ..... 83/251
3,673,905 A * 7/1972 Kono ..... 83/262
3,722,435 A * 3/1973 Elsas ..... 83/277
3,831,472 A * 8/1974 Sasaki ..... 83/277
3,882,744 A * 5/1975 McCarroll ..... 83/262
4,519,595 A * 5/1985 Adachi ..... 83/937
5,072,637 A * 12/1991 Reichental et al. ..... 83/277
5,193,424 A * 3/1993 Minichshofer et al. ..... 83/75
5,375,493 A * 12/1994 Focke et al. ..... 83/153
5,445,053 A * 8/1995 Kallner ..... 83/153
5,772,838 A * 6/1998 Zablotny et al. ..... 156/538
6,230,596 B1 * 5/2001 Reinders ..... 83/277
6,336,406 B1 * 1/2002 Wakabayashi et al. ..... 83/236
6,418,825 B1 * 7/2002 Hartmann ..... 83/110
6,460,440 B1 * 10/2002 Tsune ..... 83/153

FOREIGN PATENT DOCUMENTS

DE 198 31 992 A 1 * 1/2000 ..... 83/27

* cited by examiner

*Primary Examiner*—Allan N. Shoap
*Assistant Examiner*—Jason Prone
(74) *Attorney, Agent, or Firm*—Herbert Dubno; Andrew Wilford

(57) ABSTRACT

An apparatus for cutting sheets from an elongated workpiece is operated by first closing a pair of grippers on a workpiece leading end in an upper station and then cutting off the leading end of the workpiece to leave a sheet held in the grippers. The grippers holding the sheet are then moved downward and in an output direction to align the sheet with an output plane and pass the sheet to an output conveyor. The grippers are opened to release the cut-off sheet to the output conveyor for displacement of the sheet away in the output direction. Then the upper gripper is moved downstream in the output direction until it is out from underneath the input station and the lower gripper is moved oppositely upstream in the output direction until it is out from underneath the released sheet on the output conveyor. The upper gripper is moved upward to immediately above the upper plane and the lower gripper upward to immediately below the upper plane. Finally the upper gripper is moved upstream in the output direction until it is above the input station and the lower gripper is moved downstream in the output direction until it is underneath the input station. After the sheet has been moved out of the input station the leading end of the workpiece is advanced on the input plane into the input station so the cycle can be repeated.

10 Claims, 4 Drawing Sheets

I
II
9
12
14
1
2
13
15
1'
6
3

I
II
9
1
11
16
1'
12
13

CUTTING AND TRANSPORTING A SHEET WORKPIECE

CROSS REFERENCE TO RELATED APPLICATION

This application is related to U.S. patent application Ser. No. 09/349,277 filed Jul. 7, 1999 with a claim to the priority of German application 198 31 992 filed Jul. 16, 1998. Application '277 issued May 15, 2001 as U.S. Pat. No. 6,230,596.

FIELD OF THE INVENTION

The present invention relates to the transporting of a sheet workpiece. More particularly this invention concerns an apparatus for cutting an end off an elongated workpiece and transporting it away from the cutting location.

BACKGROUND OF THE INVENTION

In many manufacturing processes an effectively endless flexible workpiece of paper, fabric, sheet metal, or plastic film or foil is fed discontinuously in an input direction to a cutting station where with each step or advance of the workpiece a sheet is cut off its leading end. These sheets must be transported away, typically by means of a conveyor operating continuously in an output direction transverse to the input direction. As in any production operation, it is important to be able to carry out the cutting and carrying-off operations as quickly as possible without of course damage to the workpiece.

This is typically done by gripping the leading end of the workpiece by a transporter/gripper and then cutting it free of the discontinuously arriving web workpiece. Then the gripper is moved up or down to an output level and loads the cut-off sheet into an output conveyor which extends transversely away from the input location on the output level. Once the sheet workpiece is engaged by the output conveyor, the gripper releases it and returns to the input location to grip the leading end of the web workpiece and restart the process.

Before the incoming web workpiece can be advanced and a new sheet can be cut off it, the grippers that move it to the output conveyor must be back in position. In addition it is often necessary for the sheet workpiece to be moved out of the way before the grippers can be moved back up to the input station. Due to the horizontal offset of the input and output stations, the path must be completely clear for the grippers to return to their starting position.

In some systems the gripper is formed as so-called needle beams whose points engage into the workpiece and hold it such grippers can work from one side and allow the apparatus to cycle more rapidly since they can move out of the way efficiently. They damage the workpiece edges however so that they are only usable on coarse fabrics or workpieces that are going to be trimmed.

In the simplest system the input station is directly above the output station. The grippers are spaced in the input direction and extend transversely across the workpiece, perpendicular to the input transport direction. The gripper drops straight down and then moves in the output direction to insert the workpiece into the output conveyor so it can be carried off while at the same time the workpiece is advanced in the upper station to get ready for the next cycle. Then the grippers must move further in this second direction to clear the workpieces in the lower output station and upper input station before they can be raised back up and moved horizontally back in place for the next cycle. This complex movement of the grippers takes quite some time and makes the apparatus fairly complex and large, although it does have the advantage of treating the workpiece very gently.

OBJECTS OF THE INVENTION

It is therefore an object of the present invention to provide an improved apparatus for cutting a sheet off an elongated workpiece and transporting away the cut-off sheet.

A further object is to provide an improved method of operating such an apparatus.

Another object is the provision of such an improved apparatus for cutting a sheet off an elongated workpiece and transporting away the cut-off sheet which overcomes the above-given disadvantages, that is which is simple and compact, and which cycles rapidly.

SUMMARY OF THE INVENTION

An apparatus for cutting sheets from an elongated workpiece has according to the invention a supply for feeding a leading end of the workpiece in an input direction on an upper horizontal input plane to an input station, a device for cutting the workpiece transversely of the input direction immediately upstream in the input direction from the input station, an output conveyor defining a lower horizontal output plane below the input plane in an output station below the input station and effective in an output direction transverse to the input direction, and upper and lower grippers engageable in a closed position with the workpiece in the upper station and displaceable into the lower station. This apparatus is operated according to the invention by first closing the grippers on the workpiece leading end in the upper station and then cutting off the leading end of the workpiece to leave a sheet held in the grippers. The grippers holding the sheet are then moved downward and in the output direction to align the sheet with the output plane and pass the sheet to the output conveyor. The grippers are opened to release the cut-off sheet to the output conveyor for displacement of the sheet away in the output direction. Then the upper gripper is moved downstream in the output direction until it is out from underneath the input station. The upper gripper is moved upward to immediately above the upper plane and the lower gripper upward to immediately below the upper plane. Finally the upper gripper is moved upstream in the output direction until it is above the input station and the lower gripper is moved downstream in the output direction until it is underneath the input station. After the sheet has been moved out of the input station the leading end of the workpiece is advanced on the input plane into the input station so that the cycle can be repeated. As the upper gripper is moved downstream after handing off the workpiece, the lower gripper can be held stationary or, if necessary, can be moved oppositely upstream in the output direction until it is out from underneath the released sheet on the output conveyor.

According to the invention the output station is partially underneath and partially offset in the output direction from the input station. Thus the system can work very rapidly. The ability of the grippers to move oppositely allows them to get out of the way of whatever is blocking them from moving back to the right level and allows them to slide back over and under the new workpiece end in the upper input station to start another cycle. With this system, therefore, the input station can be reloaded while the just cut sheet is being handed off, and the grippers can get back into position without having to travel through long paths.

According to the invention each upper gripper comprises two upper gripper bars spaced apart in the input direction and jointly movable vertically and in the output direction and two lower gripper bars also spaced apart in the input direction and jointly movable vertically and in the output direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
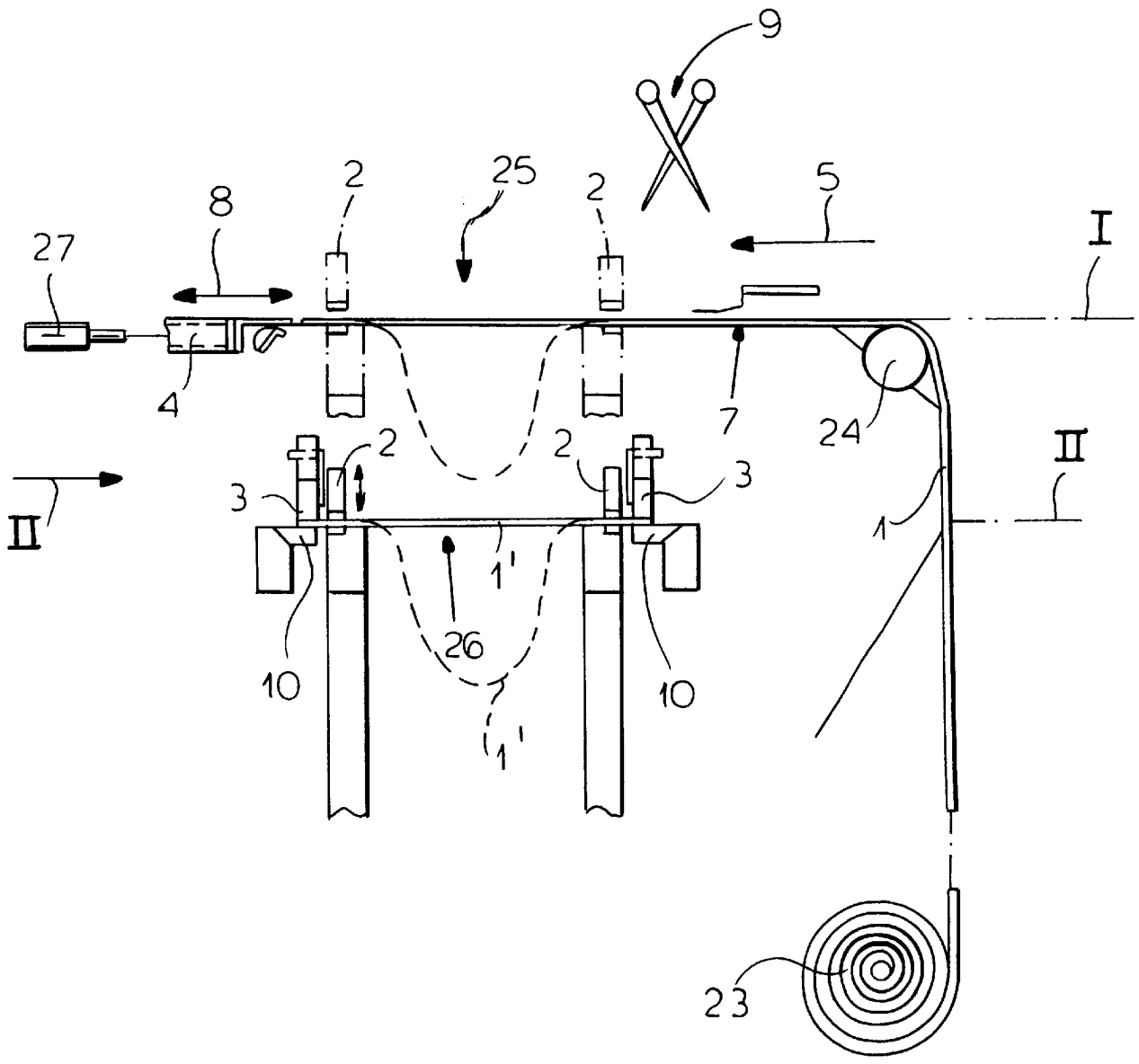
FIG. 1 is a largely diagrammatic side view illustrating the system of this invention.
Figure 2:
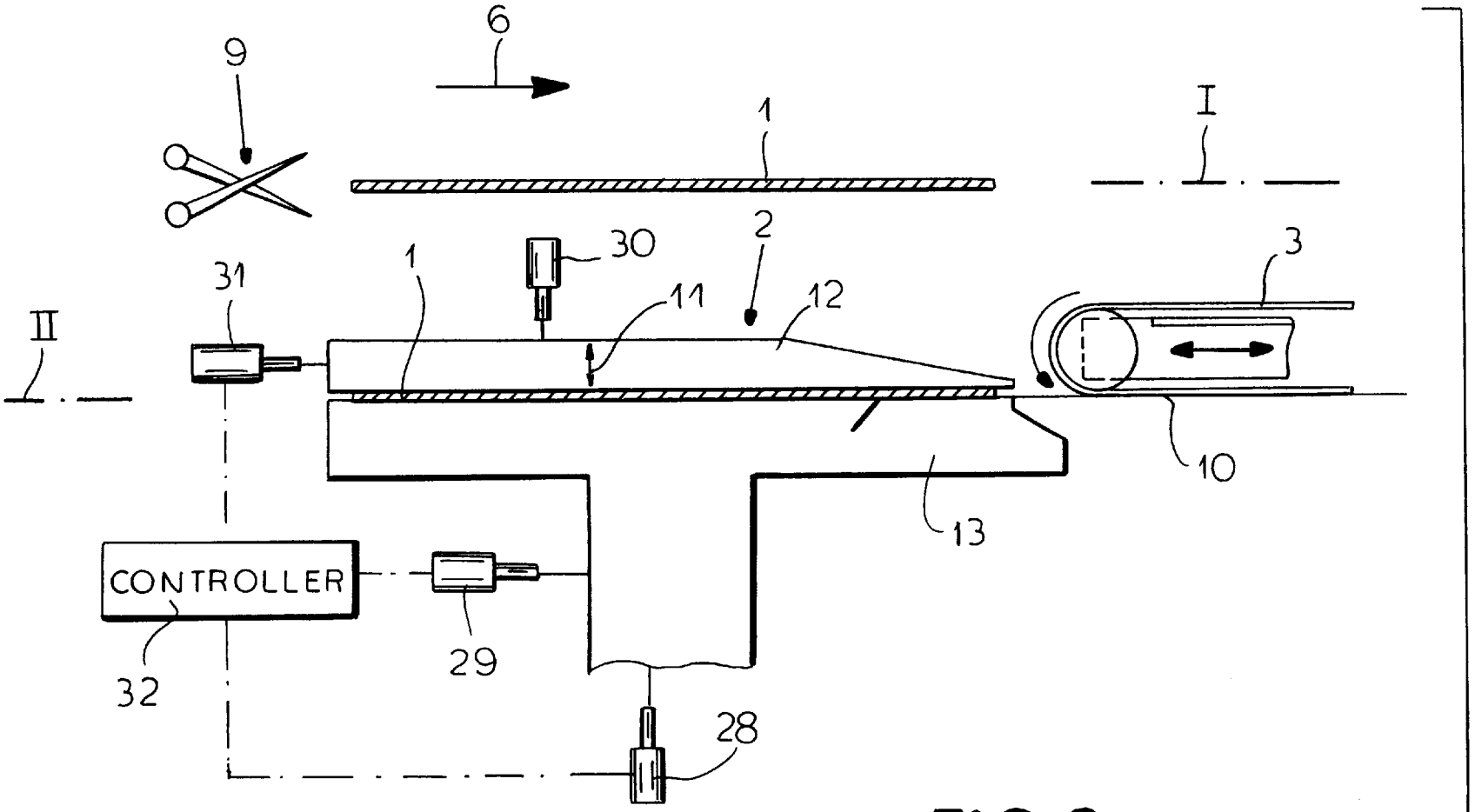
FIG. 2 is a schematic end view taken in the direction of arrow II of FIG. 1.

As seen in FIGS. 1 and 2 a flexible elongated sheet workpiece or web 1, here of paper, travels from a supply 23 over a deflecting roller 24 to move in a horizontal input direction 5 in an upper plane I into an input station 25. A holder 7 upstream of the station 25 normally grips the web workpiece 1 with enough force to prevent it from moving freely. A gripper 4 moveable by an actuator 27 upstream and downstream in the direction 5 as illustrated by arrow 8 can reciprocate back and forth through the station 25 to grip the leading edge of the workpiece 1 and advance the workpiece 1 in steps in the direction 5 through the station 25.

A pair of grippers 2 flank the station 25 and can engage leading and trailing ends of a piece 1' cut from the leading end of the web workpiece 1 by a cutter indicated schematically at 9. This cutter 9 can be a rotary driven blade reciprocable transversely to the direction 5, a beam-type slitter, or any conventional device that forms a cut perpendicular to the direction 5.

Thus with each operation cycle the gripper 4 is moved upstream by the actuator 27 against the direction 5 to grip the leading end of the web 1 and pull it downstream through the station 25. Once in the station 25, the leading end of the web 1 is engaged by the grippers 2 and the gripper 4 releases. Then the cutter 9 severs a sheet 1' from this leading end, leaving it held in the grippers 2. The sheet workpieces 1' cut from the workpiece 1 can either be substantially planar as shown in solid lines, or droop somewhat centrally as shown in dashed lines.

Underneath the station 25 and normally somewhat downstream of it in the direction 5 is an output station 26 having a conveyor 3 comprised of a pair of belts cooperating with respective smooth rails 10. The grippers 2 extend perpendicular to the direction 5 and engage each piece 1' (or pieces 1' as described below) somewhat upstream of its leading edge and downstream of its trailing edge so that these edges project in and against the direction 5 from the grippers 2. Once the piece 1' is cut from the workpiece 1 the grippers 2 drop between the conveyors 3 as shown by arrow 11 to fit these projecting edges of the sheet 1' between the conveyor belts 3 and their rails 10 which are continuously driven to carry away the sheet 1' in a horizontal output direction 6 perpendicular to the horizontal input direction 5. If necessary the conveyor 3 and/or the grippers 2 are movable horizontally to ensure that the sheet edges are fitted properly to the conveyor 3 before the grippers 2 open and allow the sheet 1' to be carried off in direction 6.

Figure 3:
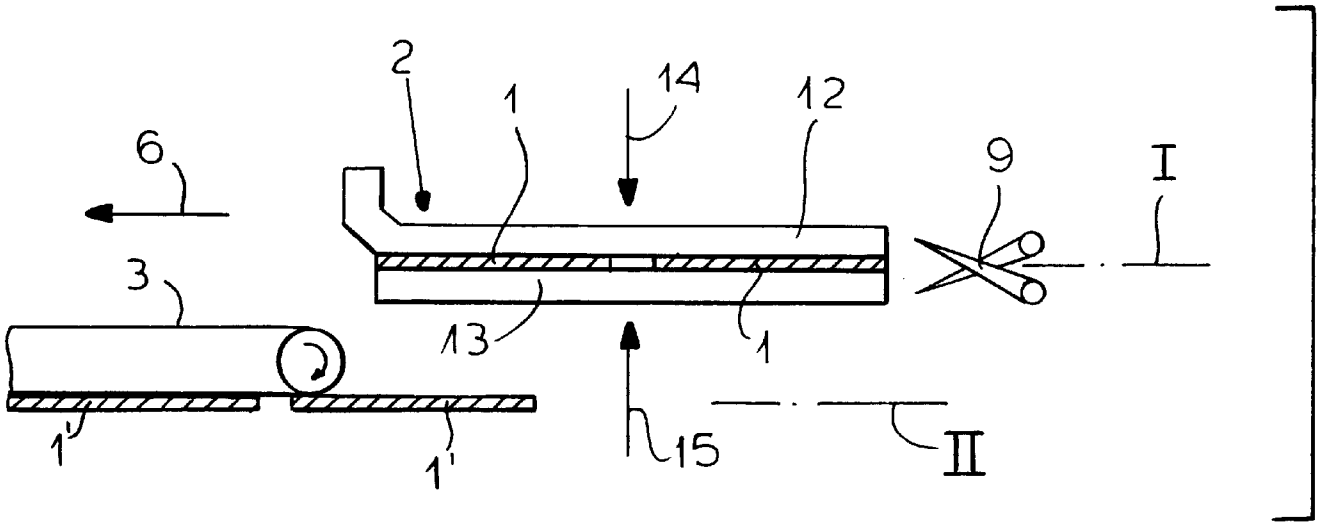
FIGS. 3 through 6 are end views seen from the opposite direction as FIG. 2 and illustrating the steps of the method of the invention.
Figure 4:
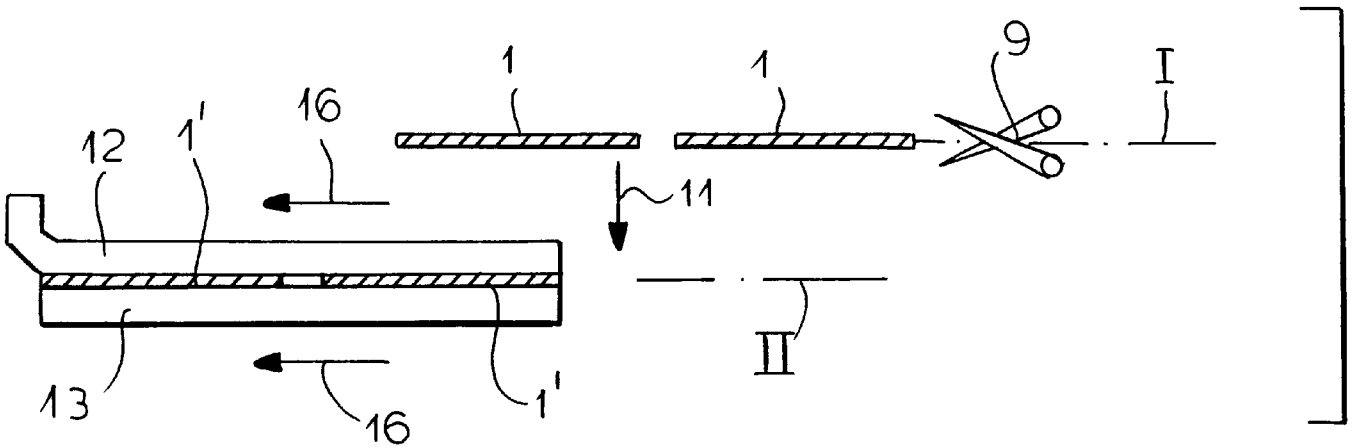

More particularly as shown in FIGS. 3 through 6, the grippers 2 each comprise an upper bar 12 and a lower bar 13 that can be brought together vertically by actuators 28 and 30 (FIG. 2) as indicated by arrows 14 and 15 to grip the leading end of one or more workpieces 1 at the upper plane I. Once the end is gripped as shown in FIG. 3, the cutter 9 severs a piece 1' from it and then as shown in FIG. 4 the bars 12 and 13 move down in direction 11 to the plane II and then are moved downstream by actuators 29 and 31 (FIG. 2) as indicated by arrows 16 to move into the output station 26, align with the output conveyor 3, and fit the sheet 1' to it. Here the output station 26 is not directly underneath the station 25 but is offset somewhat in the direction 6 from it. A controller 32 controls all the actuators 28–31 as well as the actuator 27 for the gripper 4 and the cutter 9.

Figure 5:
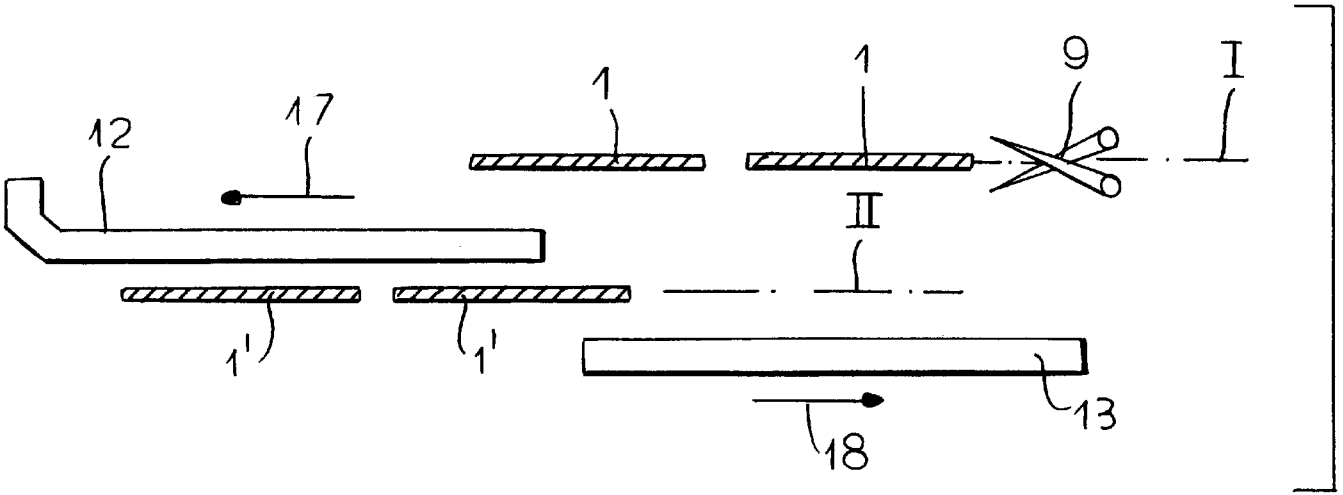

Subsequently as shown in FIG. 5 the upper bar 12 is moved up and downstream in the output direction 6 as indicated by arrow 17 and the lower bar 13 is moved slightly down and then back upstream against direction 6 as indicated by arrow 18. These movements as shown by arrows 17 and 18 are carried out until the trailing end of the bar 12 is downstream in the direction 6 from the workpiece 1 in the upper plane I and the bar 13 is similarly clear upstream of the workpiece 1 at the lower plane II. If the lower output station 26 is not directly underneath the upper input station 25, the lower gripper 13 does not have to move horizontally at all, but instead can simply move vertically.

Figure 6:
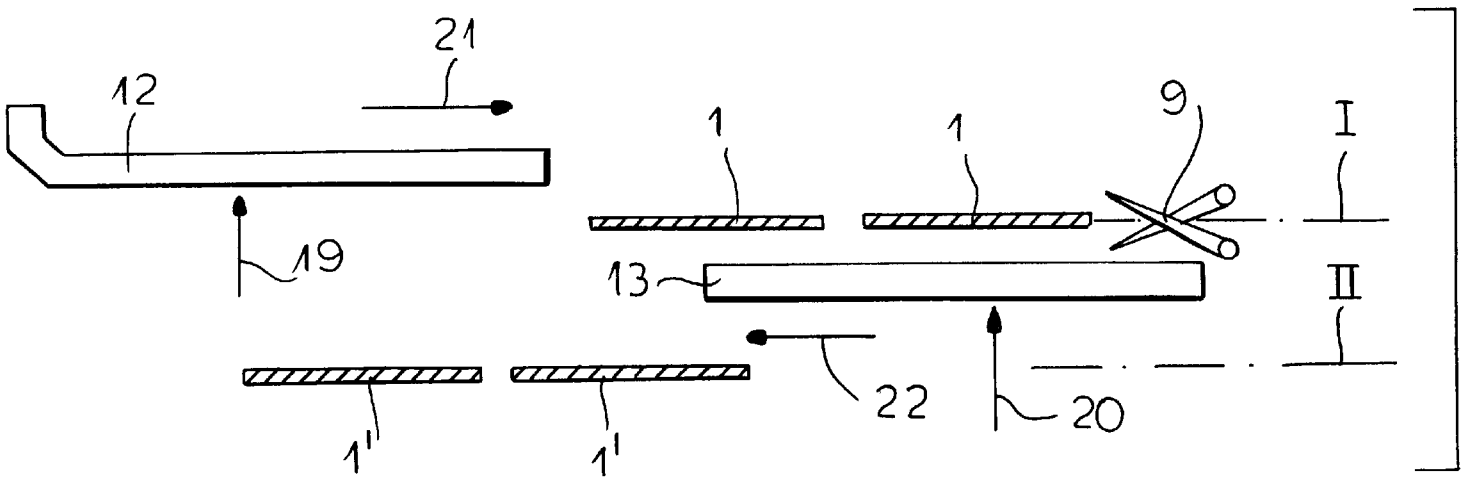

Once the bars 12 and 13 are clear, they are moved up as indicated by arrows 19 and 20 in FIG. 6 and then back into alignment with the workpiece 1 in the station 25 as shown by arrows 21 and 22. The system is then set to repeat the cycle by closing the bars 12 and 13 together as shown by arrows 14 and 15 in FIG. 3.

Thus with the system of this invention the horizontal movability of the bars 12 and 13 allows them to get out of the way of the sheets 1' and the workpiece 1 and get back to their starting positions in an efficient maimer. The system can therefore cycle very rapidly.

I claim:

1. A method of operating an apparatus for cutting sheets from an elongated workpiece, the apparatus comprising:

supply means for feeding a leading end of the workpiece in an input direction on an upper horizontal input plane to an input station;

means for cutting the workpiece transversely of the input direction immediately upstream in the input direction from the input station;

an output conveyor defining a lower horizontal output plane below the input plane in an output station below the input station, the output conveyor being effective in an output direction transverse to the input direction; and upper and lower grippers engageable in a closed position with the workpiece in the upper station and displaceable into the lower station.

2. The method defined in claim 1 wherein the output station is partially underneath and partially offset in the output direction from the input station.

3. The method defined in claim 1 wherein each upper gripper comprises two upper gripper bars spaced apart in the input direction and jointly movable vertically and in the output direction and two lower gripper bars also spaced apart in the input direction and jointly movable vertically and in the output direction.

4. The method defined in claim 1 wherein during step e) the lower gripper is held stationary.

5. The method defined in claim 1 wherein during step e) the lower gripper upstream is displaced in the output direction until it is out from underneath the released sheet on the output conveyor.

6. An apparatus for cutting sheets from an elongated workpiece, the apparatus comprising:

supply means for feeding a leading end of the workpiece in an input direction on an upper horizontal input plane to an input station;

means for cutting the workpiece transversely of the input direction immediately upstream in the input direction from the input station;

an output conveyor defining a lower horizontal output plane below the upper input plane in an output station below the input station, the output conveyor being effective in an output direction transverse to the input direction;

upper and lower grippers engageable in a closed position with the workpiece in the upper station and displaceable into the lower station, control means connected to the supply means, cutting means, output conveyor, and grippers for sequentially:

a) closing the grippers on the workpiece leading end in the upper station;

b) cutting off the leading end of the workpiece to leave a sheet held in the grippers;

c) displacing the grippers holding the sheet downward and in the output direction to align the sheet with the output plane and pass the sheet to the output conveyor;

d) opening the grippers and releasing the cut-off sheet to the output conveyor for displacement of the sheet away in the output direction;

e) displacing the upper gripper downstream in the output direction until it is out from underneath the input station;

f) displacing the upper gripper upward to immediately above the upper plane and displacing the lower gripper upward to immediately below the upper plane;

g) displacing the upper gripper upstream in the output direction until it is above the input station and displacing the lower gripper downstream in the output direction until it is underneath the input station; and h) during steps c) and d) advancing the leading end of the workpiece on the input plane into the input station, whereby steps a) through h) can be repeated.

7. The apparatus defined in claim 6 wherein each upper gripper comprises a pair of upper gripper bars spaced apart in the input direction and jointly movable vertically and in the output direction and a pair of lower gripper bars also spaced apart in the input direction and jointly movable vertically and in the output direction.

8. The apparatus defined in claim 7 wherein a spacing transversely of the input direction between each pair of bars is adjustable.

9. The apparatus defined in claim 6 wherein the lower gripper is displaceable upstream in the output direction until it is out from underneath the released sheet on the output conveyor.

10. The apparatus defined in claim 6 wherein the lower grip is stationary.

* * * * *

UNITED STATES PATENT AND TRADEMARK OFFICE

CERTIFICATE OF CORRECTION

PATENT NO. : 6,601,489 B2
DATED : August 5, 2003
INVENTOR(S) : Peter Reinders

It is certified that error appears in the above-identified patent and that said Letters Patent is hereby corrected as shown below:

Column 4,
Lines 43-58, should read:

1. A method of operating an apparatus for cutting sheets from an elongated work-piece, the apparatus comprising:

supply means for feeding a leading end of the workpiece in an input direction on an upper horizontal input plane to an input station;

means for cutting the workpiece transversely of the input direction immediately upstream in the input direction from the input station;

an output conveyor defining a lower horizontal output plane below the input plane in an output station below the input station, the output conveyor being effective in an output direction transverse to the input direction;

upper and lower grippers engageable in a closed position with the workpiece in the upper station and displaceable into the lower station, the method comprising the steps of sequentially:

a) closing the grippers on the workpiece leading end in the upper station;

b) cutting off the leading end of the workpiece to leave a sheet held in the grippers;

c) displacing the grippers holding the sheet downward and in the output direction to align the sheet with the lower output plane and pass the sheet to the output conveyor;

d) opening the grippers and releasing the cut-off sheet to the output conveyor for displacement of the sheet away in the output direction;

e) displacing the upper gripper downstream in the output direction until it is out from underneath the input station;

f) displacing the upper gripper upward to immediately above the upper plane and displacing the lower gripper upward to immediately below the upper plane;

g) displacing the upper gripper upstream in the output direction until it is above the input station and displacing the lower gripper downstream in the output direction until it is underneath the input station; and h) during steps c) and d) advancing the leading end of the workpiece on the input plane into the input station, whereby steps a) through h) can be repeated.

UNITED STATES PATENT AND TRADEMARK OFFICE

CERTIFICATE OF CORRECTION

PATENT NO. : 6,601,489 B2
DATED : August 5, 2003
INVENTOR(S) : Peter Reinders

It is certified that error appears in the above-identified patent and that said Letters Patent is hereby corrected as shown below:

Column 5, lines 7-33 and Column 6, lines 1-17,
Claim 6, should read:

6. An apparatus for cutting sheets from an elongated workpiece, the apparatus comprising:

supply means for feeding a leading end of the workpiece in an input direction on an upper horizontal input plane to an input station;

means for cutting the workpiece transversely of the input direction immediately upstream in the input direction from the input station;

an output conveyor defining a lower horizontal output plane below the input plane in an output station below the input station, the output conveyor being effective in an output directon transverse to the input direction; and upper and lower grippers engageable in a closed position with the workpiece in the upper station and displaceable into the lower station.

Signed and Sealed this

Seventh Day of March, 2006

JON W. DUDAS
*Director of the United States Patent and Trademark Office*